United States Patent [19]

Houghton

[11] 4,024,527

[45] May 17, 1977

[54] DELAYED SIGNAL WATCHMAN'S TOUR SUPERVISORY SYSTEM

[76] Inventor: Frank W. Houghton, 1000 Tarpon Center Drive, Venice, Fla. 33595

[22] Filed: June 27, 1975

[21] Appl. No.: 591,169

[52] U.S. Cl. ..... 340/306; 346/144; 361/166

[51] Int. Cl.[2] ..... G08B 25/00

[58] Field of Search ..... 340/306, 305, 309.1, 340/309.4; 58/152 B; 346/144; 317/139; 200/33 B, 38 B; 307/115, 141, 141.8

[56] References Cited

UNITED STATES PATENTS

| | | | |
|---|---|---|---|
| 3,237,183 | 2/1966 | Eagan | 317/139 X |
| 3,736,561 | 5/1973 | Rumpel | 340/309.1 X |
| 3,774,193 | 11/1973 | Restrepo | 346/144 X |

*Primary Examiner*—William M. Wannisky

[57] ABSTRACT

A plurality of watch stations are installed in protected premises that must be tripped in proper sequence once each hour and embodies means whereby when the watchman comes on duty and starts his rounds of duty, a signal will be transmitted to the central station and when he has completed the rounds of stations a second signal will be transmitted to the central station indicating that all is well. In the event the proper sequence of operation of the watchman's stations is broken, an alarm will be indicated in the central station. Thus the central station receives only two signals regardless of the number of stations on the watchman's route unless there is something wrong with the watchman and he is in need of help. The present system is designed to prevent tampering with the system, to prevent the system being turned off prior to the end of the watchman's tour of duty, and to permit the watchman to signal for outside help from anyone of the stations on his tour.

The signalling system further includes a timer controlled visible signal ignited when the watchman comes on the job and turns on the system and which visible signal is turned on after the watchman has operated the last signal box in the system to indicate the interval of time until the watchman must start his tour of the signal boxes, together with an audible signal controlled by the timer which is energized in the event the watchman does not start his tour of the signal boxes when the visible signal is extinguished.

8 Claims, 3 Drawing Figures

DELAYED SIGNAL WATCHMAN'S TOUR SUPERVISORY SYSTEM

This invention is Delayed Signal Watchman's Tour Supervisory System and it relates particularly to systems commonly used to supervise watchmen by electrical circuits connected to a remote central station. In systems of this character, now generally in use, it is common practice to provide code transmitters, in the protected premises, at each location that a watchman is required to visit every hour while he is on duty. In large buildings, or areas, that are to be patrolled it is possible to have as many as 15 to 25 watch boxes, each including a transmitter for the watchman to check each hour while he is on duty. Each transmitter sends a predetermined code signal over the transmission circuit to the central station for the attention of an operator there.

Since the central station supervises a large number of watchmen for various locations, it is possible that the central station will receive a large number of signals each hour in order to supervise these watchmen. In many cases there will be as many as five watchmen supervisory systems connected to one circuit in the central station and the possibility of a clash of signals is prevalent as two, or more, watchmen might trip a box at the same time. The absence of any one of these signals indicates the watchman failed to reach the location of the transmitter and he may be in danger and in need of outside help. Since each operator in the central station has a number of watchmen to supervise, it is possible that he would have from 60 to 100 code signals to check each hour and he might have up to five clashes of signals during the hour, therefore, the operator may be confused and not realize that a signal has been missed.

The purpose of a watchman's supervisory system is to see that the watchmen arrive on the job at the proper time and that they remain on the job throughout their tour of duty. It also supervises the watchman's activities while on the job to see that he performs the duties laid out for him and checks the entire premises at least once each hour covering boiler rooms, sump pumps, safes and vaults, stockrooms and all other strategic areas. It is also important that he does not become incapacitated through sickness, excessive drinking, injury, going to sleep or being waylaid.

The principle on which this invention works is to provide a one hour timer which will signal a central station unless the watchman performs the duties required of him prior to the time the signal is to be transmitted to the central station. It also provides a means for the watchman to signal the central station at the time he comes on duty as well as when he has completed his tour of duty.

It is so designed that any attempt on the part of the watchman, or any other person, to tamper with the system to put it out of order, or turn it off after the system has been activated, will signal the central station. All tour stations which are located throughout the protected premises are so designed that the watchmen can signal for help at any time from any station while the system is activated.

It is an object of this invention to provide an improved automatic watchman supervisory system that will furnish complete supervision of the watchman from the time he comes on duty to the time he completes his tour of duty.

It is also an object of this invention to provide a system which will enable the watchman to signal for outside help from any watch station at any time in the event that help is required.

Another object of this invention is to provide complete supervision of the watchman's activities, while he is on duty, without transmitting a large number of unnecessary signals to the central station throughout his tour of duty.

It is also an object of this invention to provide a positive alarm signal to the central station in the event the watchman fails to make or complete his hourly tour of the premises at the proper time.

It is also an object of this invention that it can be used in connection with any type of central station signal device and can be used in conjunction with central station burglar alarm systems to provide the benefits of watchman service as well as burglar alarm protection on safes, vaults, stockrooms and other areas requiring complete and constant protection.

It is also an object of this invention to trip a positive alarm signal to the central reporting station if the watchman fails to actuate any watch station within a prearranged time limit.

The operation of this invention is as follows: The watchman, when he first comes on duty will turn the control switch on the watchman's tour system to the "ON" position which will complete the circuit for the central station signal unit and will also start the motor on the one hour timer. He will then turn on the central station signal unit to transmit a signal to the central station that he is on duty and the watch system is in operation. A signal light on the front of the watchman's tour control panel will light as soon as the control switch is turned on indicating to the watchman that the system is still on the rest period and he is not to start his first tour of the premises. This light will remain on for about five minutes to give the watchman time to take care of any items required before starting his tour of the premises. When the light goes out it is an indication to the watchman that he can start his first tour.

A horn is also provided to sound about five minutes after the signal light went out to give the watchman an audible warning that it is time to start his tour. If the watchman has started his tour and the first station has been tripped before the time for the horn to sound it will be silent. From this time on it will be necessary for the watchman to visit each watch station in proper sequence and at the proper time in order to prevent the system from transmitting an alarm signal to the central station.

When the watchman has completed his tour of the premises and visited all the watch stations in proper sequence within the required time the system will recycle for the next hourly tour. At the end of the watchman's tour of duty he will turn the central station signal unit off and the watchman's tour system, thus signalling the central station that he has completed his tour of duty.

Figure 1:
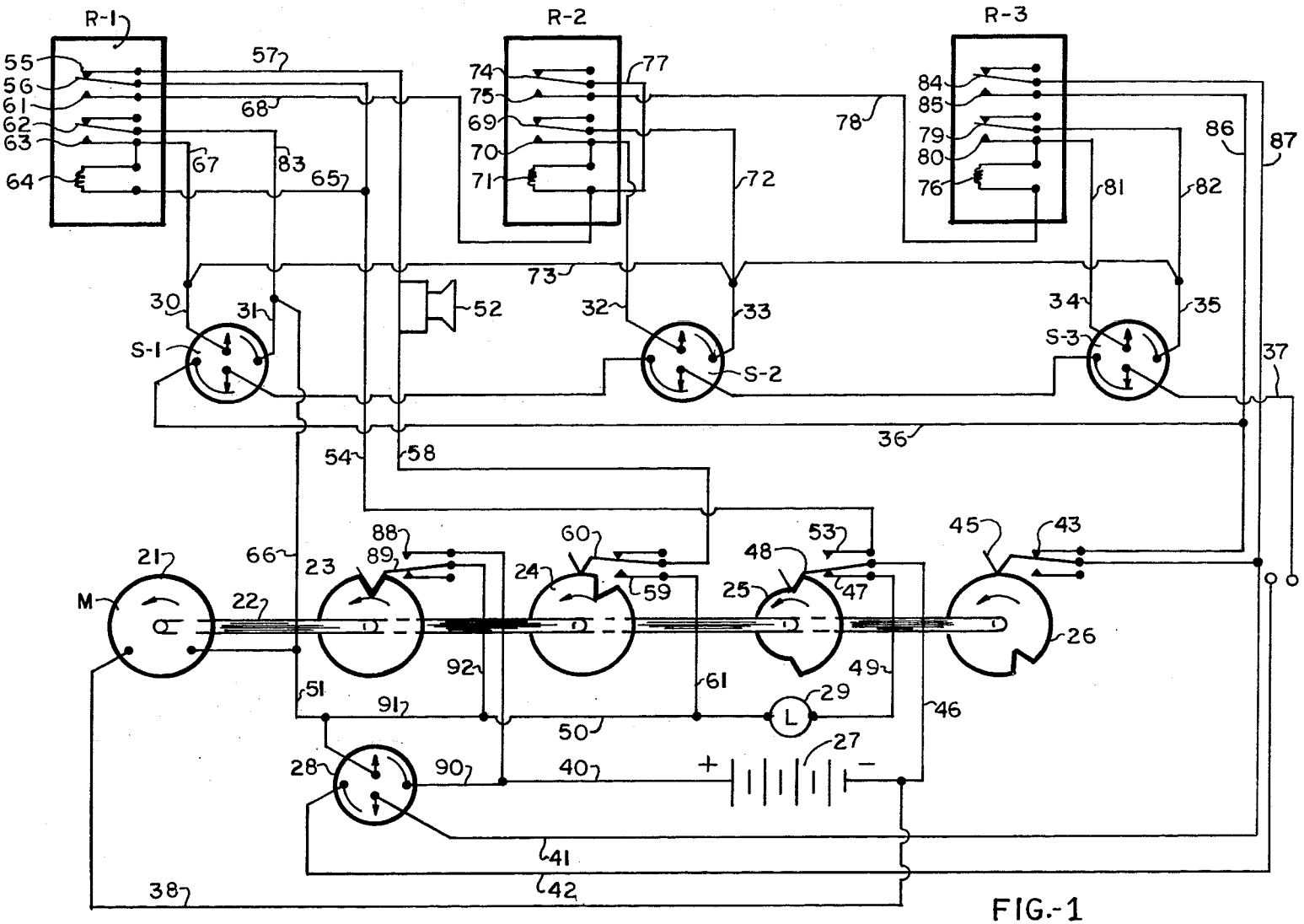
FIG. 1 is a diagrammatic view illustrating the schematic wiring of the invention.

The system includes a recycle timer of approved construction which can be purchased on the open market with a 6 volt direct current motor 21 that drives a shaft 22 with four cam wheels 23, 24, 25 and 26 counterclockwise at the rate of one revolution per hour. It also has one relay with double pole double throw contacts for each watchman's tour station on the system. A 6 volt direct current power supply 27 furnishes the power to operate the timer and the relays. A control switch 28 and an indicator light 29 is mounted on the front of the control box which encloses these items. The control box, as well as each of the watchman's stations, are constructed to prevent the watchman or any other person from tampering with the system to put it out of order.

Figures 2, 3:
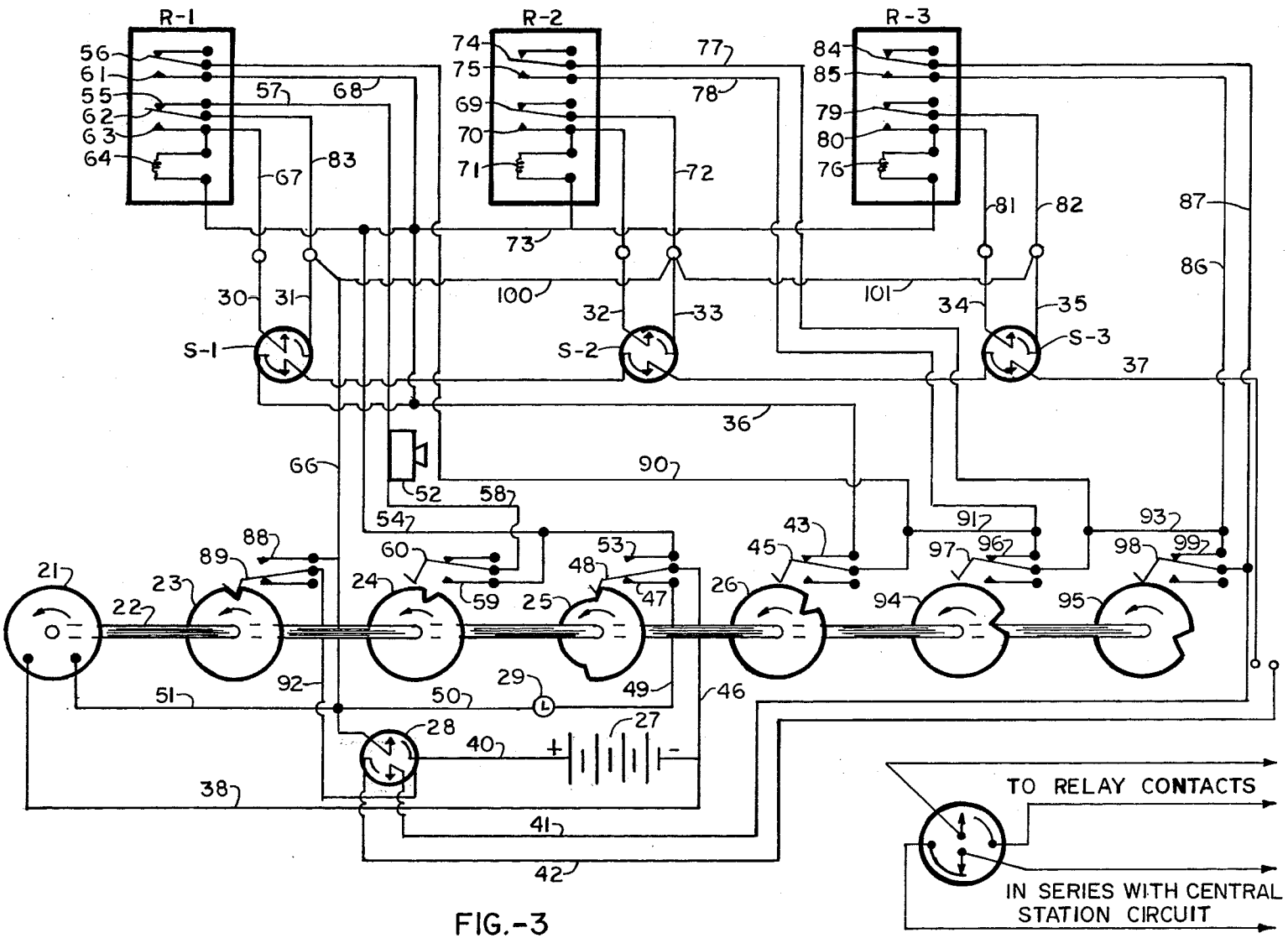
FIG. 2 is a detailed view of one of the watchman's stations.
FIG. 3 is a diagrammatic view illustrating the schematic wiring of a modified form of the invention which limits the time between each station or each group of stations.

The watchman's tour station (as shown in FIG. 2) is a small metal housing with tampers to prevent the removal of the cover or prying the housing off the wall. It has a double pole throw switch controlled by a lock. The key in the lock can be removed in the center position only. The switch has bridging contacts so the circuits will not open as the switch is turned from one contact to the other.

One set of contacts is used to close a momentary circuit to energize the relay in the control panel when the key is turned to the right.

The other set of switches is connected in series with the tamper switches in the tour station and the central station signal transmitter circuits. This circuit will be held closed while the key is in the center position as well as when it is turned to the right, however, the circuit will be opened if the key is turned to the left thus tripping the central station transmitter. All as will be hereinafter more specifically related to the overall operation of the system.

The watchman's stations are mounted throughout the protected premises and they are connected to the relays in the control box by conductors 30, 31, 32, 33, 34 and 35. Each station is also connected to the central station signal unit through conductors 36 and 37.

When the watchman first comes on duty he is to turn the control switch 28 to the "ON" position to start the motor 21 which is powered by the 6 volt pack 27 through conductors 38 and 51, lock 28 and conductors 90 and 40. When the control switch is turned on it also closes a circuit to the central station signal unit through conductors 41 and 42, contacts 43 and 45, and conductors 36 and 37 which will then enable him to turn the control switch on the central station signal unit to the "ON" position thus transmitting a signal to the central station that he is on duty and the watchman's tour system is in operation. The signal light on the front of the control box 29 will light as soon as the control switch 28 is turned on through conductors 46, contacts 47 and 48, conductors 49 and 50, lock 28 and conductors 90 and 40.

This light indicates to the watchman that the system is still on the rest period of the cycle and he is not to start his first tour of the premises until the light is extinguished. After the system has been turned on for about five minutes the cam wheel 25 will have turned sufficiently to open contacts 47 and 48 to extinguish the signal light 29 and close a circuit to the horn 52 through contacts 48 and 53, conductor 54, contacts 55 and 56, conductors 57 and 58, contacts 59 and 60 on cam wheel 24, conductors 61, 50 and 91, lock 28 and conductors 90 and 40. The signal horn will not sound for an additional five minutes until cam wheel 24 has reached a point where contact 60 will drop into the notch cut on the periphery of the cam to make contact with contact 59. The purpose of this horn is to give the watchman an audible signal that it is time to start his tour of the premises. If the watchman has started his tour and the first station has been tripped the relay R1 will have been energized to open contacts 55 and 56 to silence the horn.

Relay R1 will remain open until watch station S1 is tripped to close a momentary circuit through conductors 30 and 31 across holding contacts 62 and 63 completing a circuit from the power pack 27 through conductors 40 and 90, lock 28, conductors 51, 66 and 83, contacts 62 and 63, relay coil 64, conductors 65 and 54, contacts 53 and 48 and conductor 46 to power pack 27. When this relay is energized it will open contacts 55 and 56 to silence the horn and close the holding contacts 62 and 63 to keep the relay energized and close contacts 56 and 61 to furnish power to relay R2 through conductors 68 when station S2 is tripped.

Relay R2 will remain open until watch station S2 has been tripped to close a momentary circuit through conductors 32 and 33 across the holding contacts 69 and 70 on relay R2 completing a circuit from the power pack 27 through conductors 40 and 90, lock 28, conductors 51, 66 and 83, contacts 62 and 63, conductors 67, 73, and 72, contacts 69 and 70, relay coil 71, conductor 68, contacts 61 and 56, conductor 54, contacts 53 and 48 to power pack 27 through conductor 46. When this relay is closed it will close the holding contacts 69 and 70 to keep the relay energized and it will close contacts 74 and 75 to furnish the power to relay R3 through conductor 78 when watch station S3 is tripped.

Relay R3 will remain open until watch station S3 has been tripped to close a monetary circuit through conductors 34 and 35 across the holding contacts 79 and 80 on relay R3 completing a circuit from the power pack 27 through conductors 40 and 90, lock 28, conductors 51, 66 and 83, contacts 62 and 63, conductors 67, 73 and 82, contacts 79 and 80, coil 76, conductor 78, contacts 74 and 75, conductors 77 and 68, contacts 61 and 56, conductor 54, contacts 53 and 48 and conductor 46 to power pack 27.

The contacts 84 and 85 on relay R3 will also be closed to keep a shunt across contacts 43 and 45 through conductors 86 and 87 until cam wheel 26 has completed it's cycle and passed the notch cut in the periphery of cam wheel 26 thus preventing the circuit to the central station signal unit from opening to trip an alarm signal to the central station.

The one hour timer has four cam wheels 23, 24, 25 and 26 which are to open and close contacts that control certain parts of the system and limit the watchman's rest period as well as the time he is to spend on making his tour of the premises.

Cam wheel 23 recycles the timer to bring all cams back to the starting position regardless of the time the system is turned off. There are two contacts 88 and 89 that are normally open when contact 89 is resting in the notch cut in the periphery of the cam wheel. When the control switch 28 is turned to the "on" position it closes a circuit to the timer motor 21 from the power pack 27 through conductors 40 and 90, control switch 28, conductor 51, motor 21, and conductor 38 to the power pack causing the motor and all cam wheels to turn counterclockwise. When the motor has been running for 2 minutes, contacts 89 will ride up on the periphery of cam wheel 23 closing a circuit through contact 88 to complete a circuit from power pack 27 through conductor 40, contacts 88 and 89, conductors 92, 50, 91 and 51, motor 21, and conductor 38 to power pack 27, to complete the cycle after the control switch has been turned off and contact 89 has dropped into the notch on the cam 23 thus opening the circuit to stop the timer motor.

Cam wheel 24 is to sound the warning horn 52 through contacts 59 and 60 which are held open except when contact 60 drops into the notch cut in the periphery of cam 24.

Cam wheel 25 times the rest period as well as the tour period. FIG. 1 shows a wheel 25 with a thirty minute rest period (smaller periphery) and a thirty minute tour period (larger periphery). When the system is turned on contact 48 rests on the periphery making contact with contact 47 to light the indicator light 29 from the power pack 27 through conductor 46, contacts 47 and 48, conductor 49, indicator light 29, conductors 50 and 91, control switch 28, conductors 90 and 40 to power pack 27. When the timer has been running about five minutes contact 48 will ride up on the large periphery of cam or wheel 25 breaking contact with contact 47, extinguishing the light and making contact with contact 53 to furnish power to energize relay R1 through conductors 54 and 65. It also provides power to sound the horn 52 through conductors 54, contacts 56 and 55, conductors 57, horn 52, conductor 58 to contact 60 on cam 24.

Cam wheel 26 controls the contacts 45 and 43 to hold them closed to complete the central station circuit until the cam has reached the point that contact 45 drops into the notch on the periphery of the cam to break the connection with contact 43. If the watchman has completed his tour and visited all of the stations in proper sequence and within the proper time limit, relay R3 will have been energized and contacts 84 and 85 will be closed placing a shunt across the contacts 45 and 43 thus preventing the central station signal unit from transmitting an alarm signal to the central station.

The system can be expanded to accommodate any number of watchmen stations by installing additional relays in the control panel between number two relay and number three relay (on the last relay on the circuit). These additional relays will be wired into the circuit in the same manner as number two relay is installed.

Referring to the modified form of the invention as shown in FIG. 3:

The system includes a recycle timer of approved design which can be purchased on the open market with a 6 volt direct current motor 21 that drives a shaft 22 with six cam wheels 23, 24, 25, 26, 94 and 95 counterclockwise at the rate of one revolution per hour. It also has one relay with double throw double pole contacts for each watchman's tour station on the system as shown in FIG. 3 of the drawings. A 6 volt direct current power supply 27 furnishes the power to operate the timer and relays. A control switch 28 and an indicator light 29 is mounted on the front of the control box (not shown) which encloses the relays and the timer. The control box, as well as each of the watchman's stations, are completely tampered to prevent the watchman or any other person from tampering with the system to put it out of order. The watchman's stations are mounted throughout the protected premises and they are connected to the relays in the control box by conductors 30, 31, 32, 34 and 35. Each station is also connected to the central station signal unit through conductors 36 and 37.

When the watchman first comes on duty he is to turn the control switch 28 to the "on" position to start the motor 21 which is powered by the 6 volt power pack 27 through conductors 38 and 51, lock 28 and conductor 40. When the control switch is turned on it also closes a circuit to the central station signal unit through conductors 42 and 41, contacts 98 and 99, conductor 93, contacts 97 and 96, conductor 91, contacts 45 and 43, conductor 36, watch stations S1, S2, S3 and conductor 37 which enable him to set the central station signal transmitter to the "on" position thus transmitting a signal to the central station that he is on duty and the watchman's tour system is in operation. The signal light of the front of the control box 29 will light as soon as the control switch 28 is turned on through conductor 46, contacts 48 and 47, conductors 49 and 50, lock 28 and conductor 40.

This light indicates to the watchman that the system is still on the rest period of the cycle and he is not to start his first tour of the premises until the light is extinguished. When the system has been turned on for about 5 minutes the cam wheel 25 will have turned sufficiently to open contacts 47 and 48 to extinguish the light 29 and close a circuit to the horn 52 through contacts 48 and 53, conductor 54, contacts 59 and 60, conductor 58, horn 52, conductor 57, contacts 55 and 62, conductors 83 and 66, control lock 28 and conductor 40 to power pack 27. The signal horn will not sound for an additional 5 minutes until cam wheel 24 has reached the point where contact 60 will drop into the notch cut in the periphery of the cam to make contact with contact 59. The purpose of this horn is to give an audible signal to the watchman that it is time to start his tour of the premises. If the watchman has started his tour and the first watch station has been tripped the relay R1 will have been energized to open contacts 55 and 62 to silence the horn.

Relay R1 will remain open until watch station S1 is tripped to close a momentary circuit through conductors 30 and 31 across holding contacts 62 and 63 completing a circuit from power pack 27 through conductor 4, control lock 28, conductors 66 and 83, contacts 62 and 63, relay coil 64, conductors 65 and 54, contacts 53 and 48 and conductor 46 to power pack 27. When this relay is energized it will open contacts 55 and 62 to silence the horn and close holding contacts 62 and 63 to keep the relay energized and close contacts 56 and 61 to put a shunt across contacts 43 and 45 on cam wheel 26 through conductors 68, 36 and 90 to prevent tripping the central station signal transmitter when the time clock has advanced to the point where contact 45 drops into the notch cut in the periphery of cam wheel 26 to open the circuit to the central station signal transmitter.

Realy R2 will remain open until watch station S2 has been tripped to close a momentary circuit through conductors 32 and 33 across the holding contacts 69 and 70 on relay R2 completing a circuit from power pack 27 through conductor 40, lock 28, conductors 66 and 100 and 72, contacts 69 and 70, relay coil 71, conductors 73 and 54, contacts 53 and 48 and conductor 46 to power pack 27. When this relay is energized it will close the holding contacts 69 and 70 to keep the relay energized and it will close contacts 74 and 75 to put a shunt across contacts 96 and 97 on cam wheel 94, through conductors 77 and 78 to prevent tripping the central station transmitter when the time clock has reached the point contact 97 drops into the notch cut in the periphery of cam wheel 94.

Relay R3 will remain open until watch station S3 has been tripped to close a momentary circuit through conductors 34 and 35 across holding contacts 79 and 80 on relay R3 completing a circuit from the power pack 27 through conductors 40, lock 28, conductors 66, 100, 101, and 82, contacts 79 and 80, relay coil 76, conductors 73 and 54, contacts 53 and 48 and conductor 46 to power pack 27.

The contacts 84 and 85 will also be closed to hold a shunt across contacts 99 and 98 and cam wheel 95 through conductors 86 and 87 until cam wheel 95 has reached the point where contact 98 has dropped into the notch cut in the periphery of cam 95 thus preventing the circuit to the central station signal transmitter from opening and to trip an alarm signal to the central station.

The one hour timer has six cam wheels 23, 24, 25, 26, 94 and 95 which are to open and close contacts that control certain parts of the system and limit the watchman's rest period as well as the time he is to spend on making his tour of the premises.

Cam wheel 23 recycles the timer to bring all cams back to the starting position regardless of the time the system is turned off. There are two contacts 88 and 89 that are normally open when contact 89 is resting in the notch cut in the periphery of the cam wheel 23. When the control switch lock 28 is turned to the "on" position it closes a circuit to the timer motor 21 from the power pack 27 through conductor 40, control switch 28, conductor 51, motor 21, and conductor 38 to the power pack 27 causing the motor and all cam wheels to turn counterclockwise at the rate of one revolution per hour. When the motor has been running for two minutes, contact 89 will ride up on the periphery of cam wheel 23 closing a circuit through contact 88 to complete a circuit from power pack 27 through conductors 40 and 92, contacts 88 and 89, conductors 66 and 51, motor 21 and conductor 38 to power pack 27, to complete the cycle after the control switch has been turned off and until contact 89 has dropped into the notch on cam wheel 23 thus opening the circuit to stop the timer motor.

Cam wheel 24 is to sound the warning horn 52 through contacts 59 and 60 which are held open except when contact 60 drops into the notch on the periphery of cam 24.

Cam wheel 25 times the rest period as well as the period required to make the tour of the premises. FIGS. 1 and 2 show a wheel 25 with a thirty minute rest period (smaller periphery) and a thirty minute tour period (larger periphery). When the system is turned on the contact 48 rests on the smaller periphery of the cam wheel 25 making contact with contact 47 to light the indicator light 29 from the power pack 27 through conductor 46, contacts 47 and 48, conductor 49, light 29, conductor 50, control switch 28 and conductor 40 to power pack 27. When the timer has been running about 5 minutes contact 48 will ride up on the larger periphery of cam wheel 25 breaking contact with contact 47, extinguishing the light and making contact with contact 53 to furnish power to energize the relays R1, R2, R3 through conductors 54, 65 and 73. It also provides power to sound the horn 52 through conductors 54, contacts 59 and 60 on cam wheel 24, conductor 58, horn 52, conductor 57, contacts 55 and 62, conductors 83 and 66, control switch 28 and conductor 40 to power pack 27.

Cam wheel 26 controls contacts 45 and 43 to keep them closed to complete the central station transmitter circuit until the cam has reached the point where contact 45 drops into the notch cut in the periphery of the cam to break the connection with contact 43. The cam is adjusted to allow sufficient time for the watchman to trip watch station S1 which energizes relay R1 to close contacts 56 and 61 which places a shunt across contacts 45 and 43 through conductors 68, 36 and 90 thus keeping the central station transmitter circuit closed to prevent the tripping of the central station transmitter.

Cam wheel 94 controls contacts 96 and 97 to keep them closed to complete the central station transmitter circuit until the cam has reached the point where contact 97 drops into the notch cut in the periphery of the cam to break the connection with contact 96. This cam is adjusted to allow sufficient time for the watchman to travel from watch station S1 to watch station S2. The tripping of watch station S2 energizes relay R2 to close contacts 74 and 75 to put a shunt across contacts 96 and 97 through conductors 77 and 78 thus keeping the central station transmitter circuit closed to prevent tripping the transmitter.

Cam wheel 95 controls 98 and 99 to keep them closed to complete the central station transmitter circuit until the cam has reached the point where contact 98 drops into the notch cut in the periphery of cam 95 to break the connection with contact 99. This cam is adjusted to allow sufficient time for the watchman to travel from watch station S2 to watch station S3 and when watch station S3 is tripped it energizes relay R3 to close contacts 84 and 85 to put a shunt across contacts 98 and 99 through conductors 86 and 87 to keep the central station transmitter circuit closed to prevent tripping the transmitter.

The schematic shown in FIG. 3 illustrates how the elapsed time between watch stations can be controlled, however this schematic can be altered to control the elapsed time between groups of stations. For example the schematic in FIG. 1 controls the time required to visit a group of three stations. If another cam wheel were installed on the timer, another group of stations could be added to the system and the time required to visit these stations could be limited by the additional cam wheel.

In some cases a system that limits the time between stations, or groups of stations, may be desirable as it shortens the interval between the time the tour is started and the time the central station transmitter is tripped in the event the watchman fails to visit his stations in proper sequence and at the prescribed time.

It will be understood that the invention is not to be limited to the specific construction or arrangement of parts shown, but that they may be modified within the invention defined by the claims.

What is claimed is:

1. A delayed signal watchman's tour supervisory system including a plurality of spaced watchman's station each embodying a switch, a plurality of relays each connected to be operated by the operation of one of said switches, contacts on said relays for connecting the switches in the watchman's stations in sequence, a switch connected to a power source for supplying energizing power to the watchman's stations and relays means connected to said energizing switch and a monitoring station whereby upon initial operation of the energizing switch a signal in the monitoring station will be energized to indicate that the watchman is at his post, a visible signal connected to said power controlling switch and energized when the power controlling switch is turned on, timing means connected in the circuit to said visible signal to control each time period of energization of the visible signal to indicate to the watchman that he has a limited time period before operating the first of said signalling stations, an audible signal connected on the circuit to said visible signal, and means actuated by said timing means to energize said audible signal in the event the watchman has not operated the first of the series of signalling stations at such time, means operated by said timing means and connected in the control circuit to deenergize said audible means upon the operation of the first of said watchman's stations.

2. A delayed signal watchman's tour supervisory system as claimed in claim 1, wherein said relays are connected to the switches and interconnected to each other so that said watchman's signalling switch at the stations must, in normal procedures, be operated in a prescribed sequence, said relays interconnected so that when any watchman's station's switch is operated out of sequence a signal will be transmitted to the monitoring station.

3. A delayed signal watchman's tour supervisory system as claimed in claim 1, wherein said timing means is constructed to energize said visible signal when the watchman has properly actuated all of the watchman's signalling stations in the series to indicate a rest period for the watchman and whereby when the proper time of the rest period has expired the timing means will deenergize the visible signal to indicate to the watchman that it is time to start his tour for actuating the watchman's signalling stations.

4. A delayed signal watchman's tour supervisory system as claimed in claim 2, wherein the switches at the watchman's stations are double-pole switches with one of the poles of each switch connected to its relay to operate the system in its normal sequence, said relays and the second or opposite pole of the switch being interconnected and connected to the monitoring station through proper contacts and circuits, so that when the switch at any one of the watchman's stations is operated in the opposite direction to its normal operation a signal will be sent to the monitoring station that the watchman is in need of help.

5. A delayed signal watchman's tour supervisory system including a plurality of spaced watchman's signal indicating stations, each of said stations including a switch, a relay connected to said switch and to said central monitoring station, a series of cams each controlling operation of the relays, independent means operated by each cam when the watchman's station's switches are operated in proper sequence to disconnect each relay with the monitoring station, no signals will be transmitted to the monitoring station, in the event the stations are operated out of sequence said cams will operate the relay of the station operated out of sequence to connect the relay to the central station and transmit an alarm signal to the central monitoring station.

6. A delayed signal watchman's tour supervisory system as claimed in claim 5, including a switch to be operated by the watchman to energize the system when he reports for duty, a visible signal energized upon the closing of said switch, a timer mechanism for controlling the energization of the visible signal whereby it will be energized for a predetermined length of time to allow the watchman to perform such duties as required before starting upon the tour of the watchman's signalling stations and to indicate to the watchman that when the visible signal is deenergized he must start upon his tour of the watchman's signalling stations.

7. A delayed signal watchman's tour supervisory system as claimed in claim 6, including an audible signalling means in circuit with said timer and said watchman's signalling stations, a switch connecting said timer and audible signalling means for control of energizing of the audible signalling means by the timer, whereby in the event the watchman does not operate the first of the signalling stations in the series the audible means will be energized to notify the watchman of his delinquency in starting his tour of the watchman's signalling stations.

8. A delayed signal watchman's tour supervisory system as claimed in claim 5, including a timer mechanism associated with said cams and their relay operating mechanism to operate the cams and their associated mechanism in timing with a prescribed sequence for operation of the watchman's signalling stations by the watchman.

* * * * *